United States Patent [19]

Matsushita et al.

[11] 4,155,799

[45] May 22, 1979

[54] STRAPPING MACHINE

[75] Inventors: Fukumatsu Matsushita; Yoshiaki Kasuga, both of Yokohama, Japan

[73] Assignee: Nichiro Kogyo Company, Ltd., Yokohama, Japan

[21] Appl. No.: 795,492

[22] Filed: May 10, 1977

[30] Foreign Application Priority Data

Feb. 17, 1977 [JP] Japan ..... 52/16911

[51] Int. Cl.[2] ..... B32B 35/00

[52] U.S. Cl. ..... 156/494; 100/33 PB; 156/495

[58] Field of Search ..... 156/494, 495, 502; 100/33 PB

[56] References Cited

U.S. PATENT DOCUMENTS

| | | | |
|---|---|---|---|
| 3,269,300 | 8/1966 | Billett et al. | 156/502 |
| 3,566,778 | 3/1971 | Vilcins | 100/33 PB |
| 3,863,557 | 2/1975 | Takahashi | 156/502 |
| 3,866,812 | 2/1975 | Gutjahr | 100/33 PB |
| 4,020,756 | 5/1977 | Weiss | 100/33 PB |

*Primary Examiner*—Caleb Weston

*Attorney, Agent, or Firm*—Oblon, Fisher, Spivak, McClelland & Maier

[57] ABSTRACT

A strapping machine comprises a roller for reversely rotating by a one way motor to tighten a package with a band, a differential reducing mechanism engaged to a clutch whereby the roller is reversely rotated at high speed before sliding the clutch and is further reversely rotated at low speed and high torque after sliding the clutch and a seal forming shaft starts when a return roller is stopped under a predetermined tension applied by tightening the band. The strapping machine further comprises a cutter anvil to contact the inner surfaces of the bands at the superposed part with a heating element inserted into the superposed part of the bands and a cutter for cutting the band under suitable tension after cooling the heat-sealed bands.

7 Claims, 14 Drawing Figures

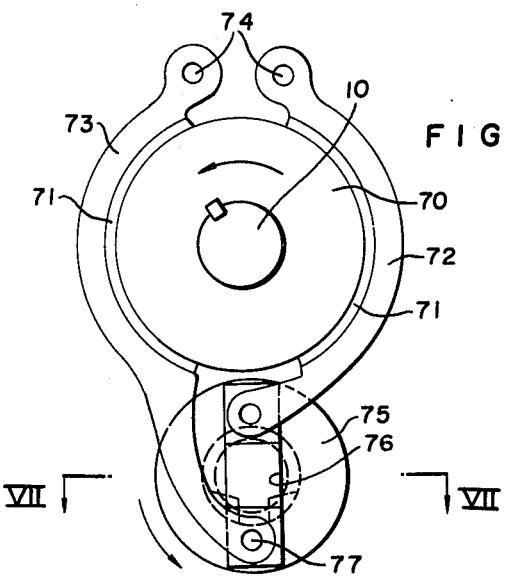
FIG. 5
FIG. 7
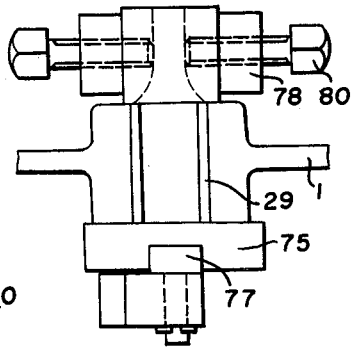
FIG. 6
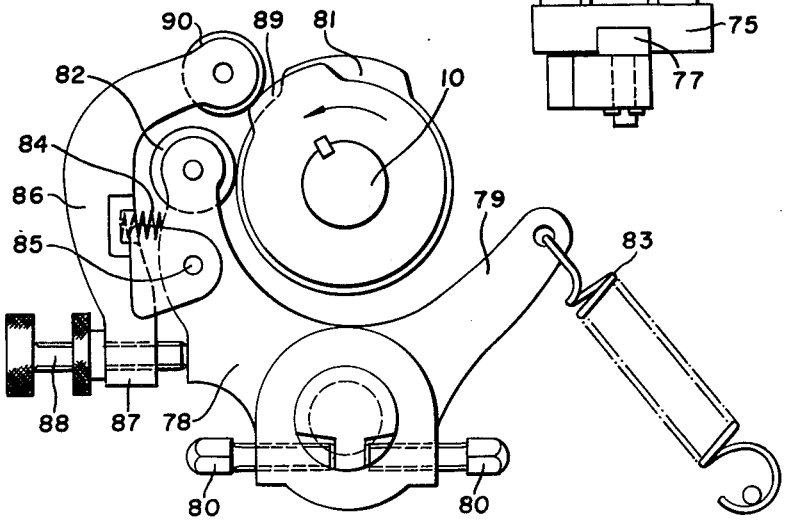

STRAPPING MACHINE

BACKGROUND OF THE INVENTION

1. Field of the Invention:

The present invention relates to an automatic strapping machine for winding a package with a thermoplastic band (hereinafter referring to as a band) and tightening the band and melt-sealing a superposed part of the band by heating under pressure and cutting the band from the feeding side adjacent to the melt-sealed part.

2. Description of the Prior Art

Various structures of the automatic strapping machine have been proposed and the fields of the applications have been rapidly broaden and various kinds of the machines have been provided depending upon size of a package, hardness, softness and compressability.

From the viewpoints of the saving of petrochemical products and articles of consumption, narrow width of band has been used whereby it has been important to maintain the parallel condition of the superposed part of the bands in the heat-sealing operation.

In a conventional automatic strapping machine, a band contacted along the peripheral part of a band feeding roller is fed into an arch under contacting with a free roller and the leading end of the band is passed through the arch is gripped with a first gripper having a cutter for cutting the band, the band feeding roller is reversely rotated to tighten the package, the end of the band is gripped by a second gripper, a heating element is inserted between the superposed part of the bands gripped by the first and second grippers without tension, the two upper and lower bands and the heating element are pressed between a cutter anvil, a pressing element and the band is cut by a cutter fixed on the side surface of the pressing element and an edge of the first gripper, the bands and the heating element are pressed to melt the surfaces of the bands contacted with the heating element and the heating element is removed to press the bands under cooling so as to heat-seal the superposed part of the band.

In the machine as disclosed in the Japanese Utility Model Publication No. 23280/1965, the package is tightened with the band by a roller which is disposed beside the band feeding roller and is always reversely rotating at high speed, and is further tightened with a tension lever in high tension when the package is wound with the band.

In these conventional machines, the following disadvantages have been found.

(1) The superposed part of the bands is heat-melted in the condition of no tension and then the heating element is removed, whereby sometimes, the band is slipped out with the movement of the heating element. Also band itself has curl whereby sometimes the superposed part of the bands is not kept in precisely parallel, and the non-parallel superposed part is sealed. Where a narrow band has been used, the disadvantageous effect is often found of a decrease in sealing strength. The present invention serves to completely overcome the disadvantageous of slip of the superposed part of the bands and to bind a package having small width.

(2) When one feed roller is forwardly and reversely rotated to attain the feeding of the band and the tightening of the package, it has been difficult to attain high speed operation because of the time-consuming switching. In order to attain proper operation, motor and transmitting parts need be increased. For example, a long length for tightening is needed to bind a compressive blanket whereas only a short length for tightening is needed to bind a wooden box. In order to tighten both of them under 60 kg of tension, the large motor and transmitting parts are needed. The present invention serves to provide a strapping machine having simple structure with a small motor.

(3) The field of the application of strapping machines have been broadened so as to sometimes be used in an environment of floating fine dust for causing wear in the sliding parts of the machine such as bricks and roof plates in a ceramics factory. In these cases, the life of the cutter is shortened. An expensive cutter made of highly quality material is dulled for short time. It is clear from our experience that a thin paper or cloth is easily cut under tension with scissors even though being dull. When the band has been cut under no tension as with a conventional machine, the band is not easily cut and a cutter made of high quality material has been needed such that the life of the cutter has been short.

The invention serves to provide a machine for easily cutting the band for long life under suitable tension.

SUMMARY OF THE INVENTION

Accordingly, a general object of the present invention is to provide a novel and unique strapping machine to quickly bind a package by speedy tightening and slow tightening in high torque.

Another object of the present invention is to provide a strapping machine to prevent slipping of the superposed part of the bands.

The other object of the present invention is to provide a strapping machine having simple structure which can bind various packages in a short amount of time.

Further, the other object of the present invention is to easily cut the band for long period of time under suitable tension.

The foregoing and other objects have been attained by the strapping machine having the following structure.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings wherein like reference numerals designate identical or corresponding parts throughout the several views, and in which:

FIG. 5 is a front view of a braking mechanism of the present invention;

FIG. 6 is a front view of a controlling mechanism for the braking mechanism;

FIG. 7 is a sectional view takne along VII—VII of FIG. 5 which shows the relationship of the braking lever, the braking mechanism and the controlling mechanism thereof;

FIGS. 8 F and G show the other steps for the same purpose.

DETAILED DESCRIPTION OF THE PREFERRED EMBODIMENTS

Figure 1:
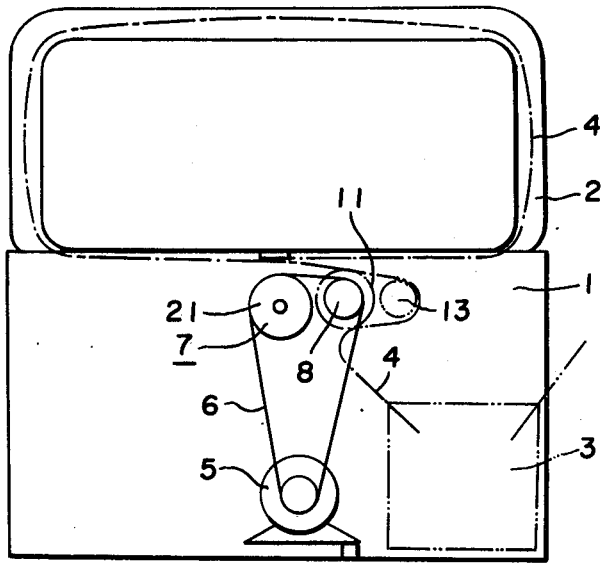
FIG. 1 is a front view of one embodiment of a strapping machine according to the present invention.

In FIG. 1, reference numeral (1) designates a strapping machine; (2) designates an arch; (3) designates a band chamber in which certain length of a band is stored under dewinding from a reel (not shown) and from which the band (4) is fed to the arch; (5) designates a motor; (6) designates a belt; (7) designates a differential reducing mechanism; (21) designates a pulley in said mechanism; (11) designates a feed roller; (13) designates a return roller.

Figure 3:
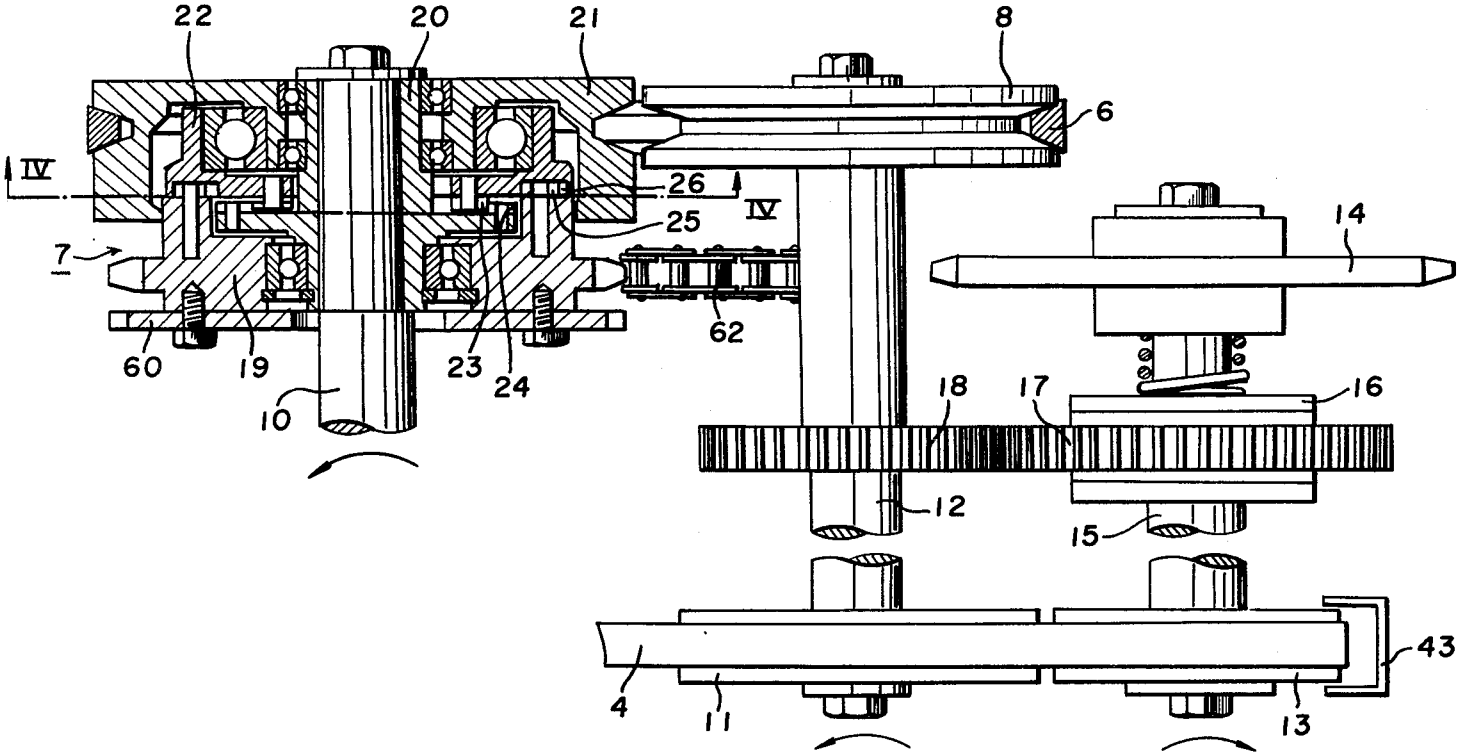
FIG. 3 is a plan view which primarily shows the differential mechanism of the present invention.

As shown in FIG. 3, the differential reducing mechanism (7) is mounted on a seal forming shaft (10) and the pulley (8) is mounted on a feed shaft (12) of the feed roller. The return roller (13) is mounted on a return shaft (15) with a sprocket (14) and with which a one way clutch is connected. A gear (17) is detachably connected through a clutch (16) between them and the gear (17) is engaged with a gear (18) mounted on the feed shaft (12). When the feed shaft (12) is rotated at high speed counterclockwise, the return shaft (15) is rotated clockwise through the gear (18), the gear (17) and the clutch (16). When the load applied to the return shaft (15) has reached a predetermined value, the clutch begins to slip to stop the rotation of the return shaft (15).

The sprocket (14), which causes the rotation of the return shaft only to clockwise direction by the one way clutch, is connected through a chain (62) to a sprocket body (19) of the differential reducing mechanism (7). No torque is transmitted from the return shaft (15) to the sprocket (14) by one way clutch in the sprocket (14), whereas torque is transmitted to rotate the return shaft (15) when the sprocket (14) is rotated clockwise (the arrow line of FIG. 3) by the sprocket (19) and the chain (62).

Figure 4:
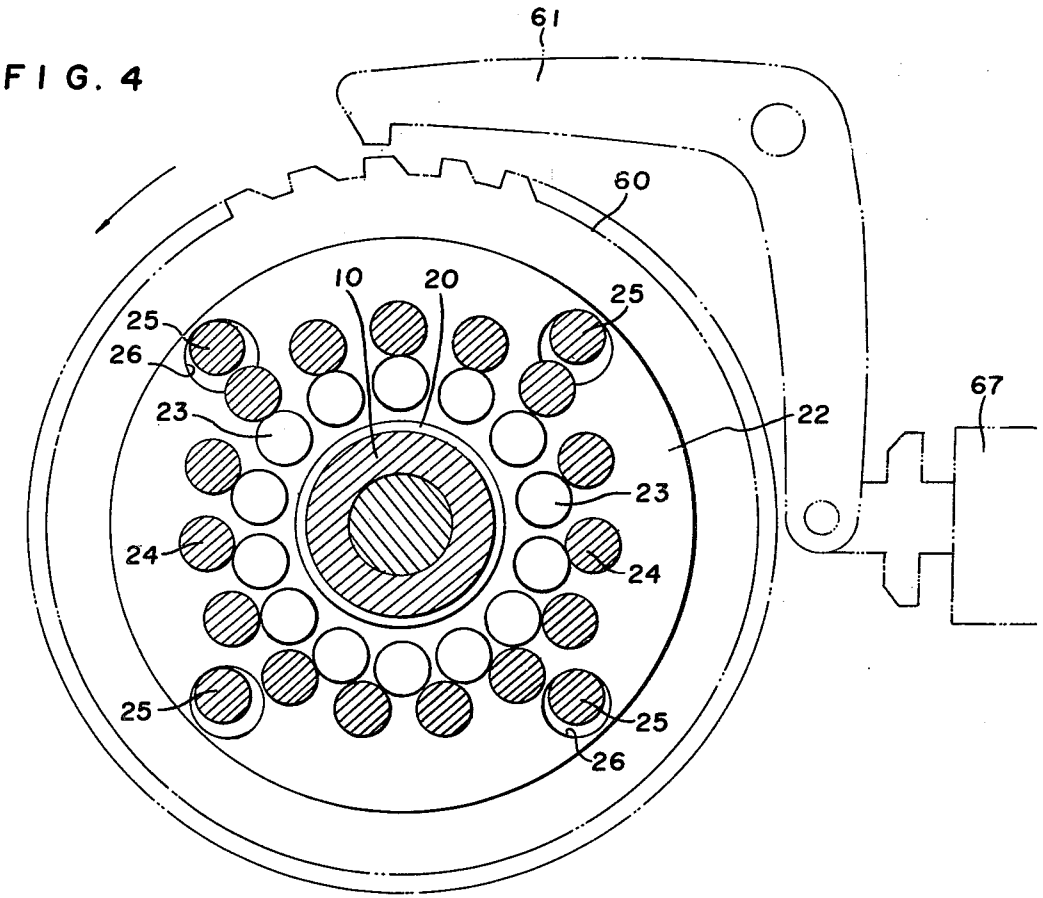
FIG. 4 is a sectional view taken along line IV—IV of FIG. 3.

Referring now to FIGS. 3 and 4, the structure of the differential reducing mechanism (7) will be illustrated hereinafter; in detail.

The differential reducing mechanism (7) comprises a base body (20) mounted on the seal forming shaft (10), a pulley (21) which is freely fitted through bearings to the base body (20), the sprocket body (19) securing a disc (60) thereto, and an eccentric body (22) fitted to the pulley body (21). A plurality of engaging rolls (23) are radially provided on the eccentric body (22) to engage with a plurality of engaging rolls (24). Four slidably rotating rolls (25) are disposed in an opening hole (26) formed in the eccentric body (22). Reference numeral (61) designates a lever freely engaging with the disc (60) of the sprocket body (19) through the actuation of a solenoid.

Regarding the function of the differential reducing mechanism, when the sprocket body (19) is in a fixed state and the movement of the eccentric body (22) is restricted by the slidably rotating roll (25) and the opening hole (26), the rotating operation of the pulley body (21) moves the eccentric body (22) and the movement is transmitted through the engaging rolls (23) and (24) to the base body (20). However, the engaging roll (23) fixed to the eccentric body (22) is shifted between the engaging roll (24) of the base body (20) whereby the rotation of the pulley body (21) may reduce the rotation of the base body (20).

According to the present embodiment of the invention, the base body (20) or the seal forming shaft (10) rotates one time per fifteen rotations of the pulley body (21) because of the existence of the fifteen engaging rollers (24).

When the load applied to the seal forming shaft (10) is larger than the load of the sprocket body (19), the shaft (10) is stopped and the sprocket body (19) rotates in low speed.

Because of the above-mentioned differential function, the rotation is limited to the shaft (10) at its reduced speed when the load applied to the sprocket body (19) is larger than the load of the shaft (10). On the contrary, the rotation is limited to the sprocket body (19) in its reduced speed when the load applied to the shaft (10) is larger than the load of the sprocket body (19).

Figure 2:
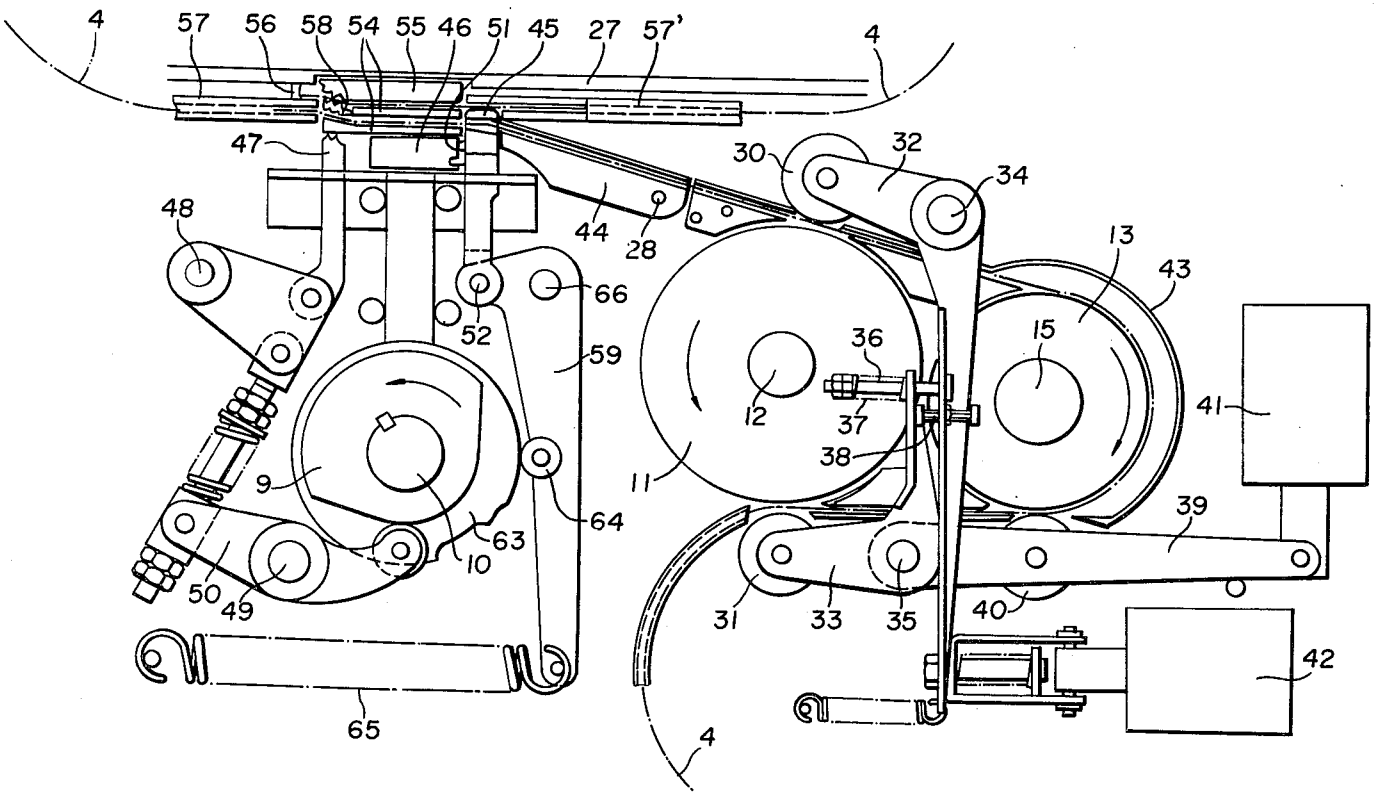
FIG. 2 is a side view of the important parts of the embodiment of FIG. 1.

In FIG. 2, the rocker rollers (30) and (31) supported rotatably on both sides of the feed roller (11) which is always rotating at high speed, are contacted to feed roller (11) under pressure by actuating the solenoid (42).

The reference numerals (32) and (33) designate lever respectively, corresponding to the rollers while (34) and (35) designate bearings. The lever (32) is connected through a spring (37) and a stopper (38) to lever (33). A movable lever (39) having the bearing (35) thereon as a fulcrum is movably supported under the return roller (13), and a rocker roller (40) and a solenoid (41) are respectively provided thereto.

Reference numeral (43) designates a guide plate; (44) designates a guide; (28) designates a pin of the guide; (46) designates a seal press head forming a cutter (51) on the right end portion thereof; (47) designates a second gripper moving up and down depending on an arm lever (50) moving along with the surface of a cam (9) of the seal forming shaft (10). Reference numeral (45) designates a cutter moving up and down depending on the rotation of a cam (63) to contact a cam roller (64) of a lever (59) providing the spring (65) on one end portion thereof while (52) and (66) designate bearings, respectively.

Reference numeral (27) designates a table; (55) designates a slide table; (54) designates a center guide for guiding the band; (58) designates a first gripper for gripping the leading end portion of the band at the position between the slide table (55) and the gripper (58). The above-mentioned second gripper (47) grips the band in the pulling side between thereof the first gripper and the second gripper. Reference numeral (56) designates a micro lever for sensing the band upon touching to the lever on the leading end portion thereof; (57) and (57') designate each end portion of the arch guide.

Figure 8:
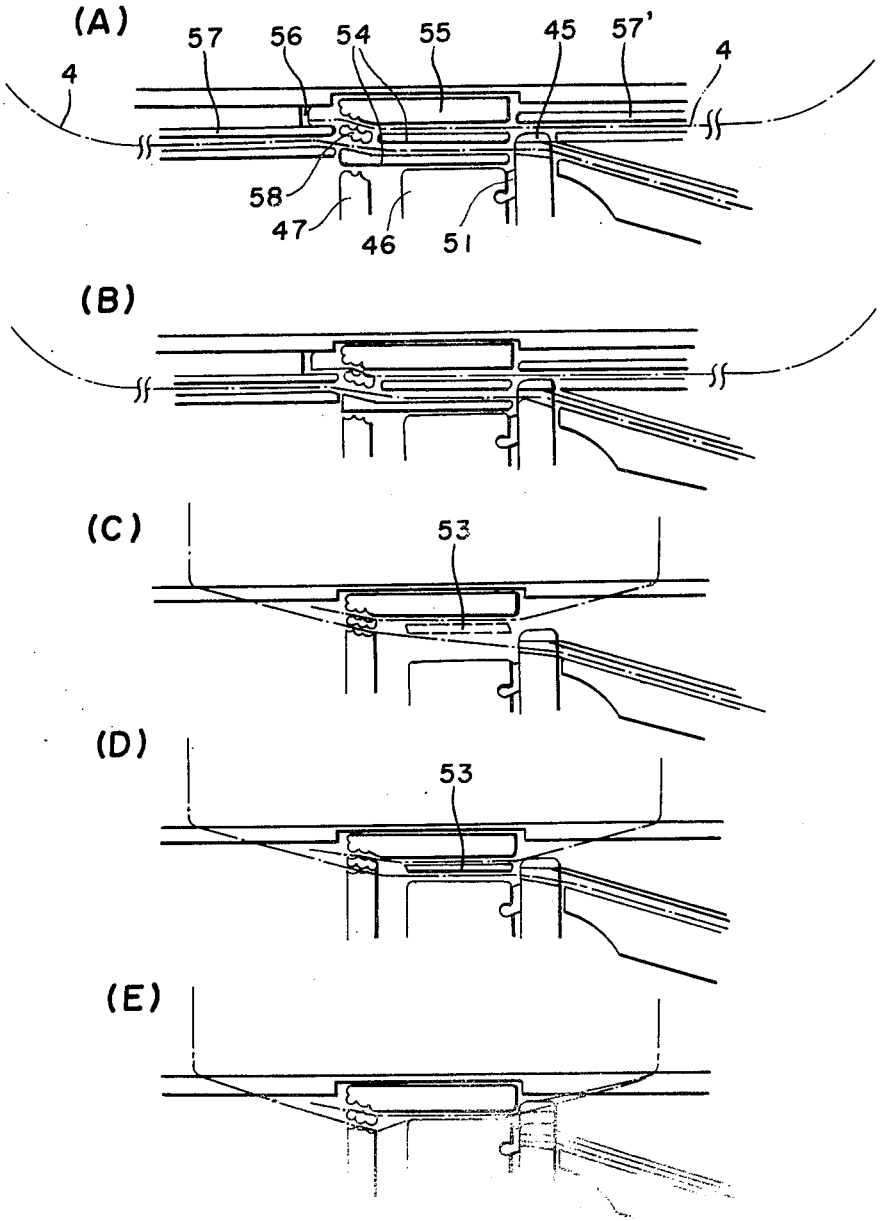
FIGS. 8 A to E show the steps from forming the superposed part of the bands to bonding the bands.
Figure 8:
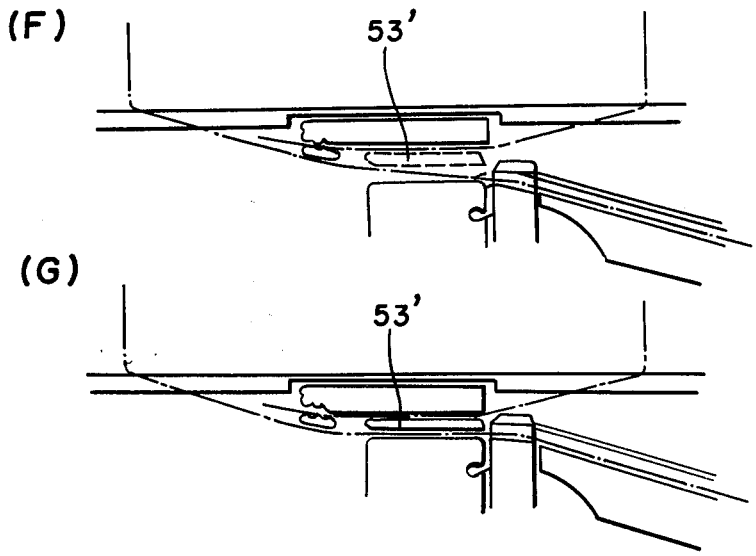

In FIG. 8, the principal process from the formation of the superposed part of the band to the completion of the heat-sealing thereof with reference to the slide table. In FIG. 8, reference numerals (53) and (53') designate a heating element.

As shown in FIG. 5, a brake drum (70) is mounted on the elementary portion of the seal forming shaft (10). In order to give resistance thereto, brake levers (72) and (73) forming thereon a brake shoe (71) made of oxhide and the like are secured to a fixed bearing (74) and a rotatable end of the brake levers is rotatably mounted to be positioned on a groove (76) of a brake operating shaft (75) connected to a bearing (29) formed on an elementary portion of the strapping machine. When the brake operating shaft (75) is rotated to the direction as shown by an arrow line, the resistance is given to either the break drum (70) or the seal forming shaft (10). In the reverse rotation of the shaft (75) a special resistance should not be given to the brake drum (70).

The seal forming shaft (10) has cams (9) and (63) (see FIG. 2) and also has a cam (81) adjacent to the above-mentioned brake drum (70) as shown in FIG. 6. A cam lever (78) is adjustably mounted on the one end of the above-mentioned brake operating shaft (75) by means of an adjusting screw (80). A cam roller (82) is mounted on the left end portion of the cam lever (78) to engage with the above-mentioned cam (81) and a spring (83) is provided separately on the right end portion of the lever (78). A pin (85) formed in the middle portion of the cam lever (78) is connected to a cam lever (86) for tightening a package and an adjusting screw (88) is mounted on the one end portion (87) of the lever (86). On the other end portion of the lever (86), a cam roller (90) is mounted to contact with a cam (89) for tightening a package provided in parallel with the above-mentioned cam (81) mounted on an elementary portion of the seal forming shaft (10). A spring (84) is mounted on the upper part of the pin (85) in order not to form any gap between the leading end portion of the above-mentioned adjust screw (88) and the corresponding portion of the cam lever (78) to the screw (88). Under the above structure of the machine, the resistance to the brake drum (70) may easily be adjustable with the operations of the adjust screws (80), (80) and (88).

The operation of the strapping machine of the invention will be illustrated hereinbelow.

The pulley body (21) of the differential reducing mechanism (7) and the pulley (8) of the feed shaft (12) are rotated at high speed by the motor (5). The feed roller (11) and the return roller (13) are respectively rotated at high speed. In these rotations, the base (20) of the differential reducing machines (7) and the seal forming shaft (10) are in the stop condition of position. When the solenoid (42) is actuated, the levers (32) and (33) move to contact the rocker rollers (30) and (31) on the surface of the feed roller (11) under pressure, whereby the band is fed into the arch guide (57).

In the operation, band (4) can be smoothly fed without contacting the return-roller (13) when the rocker roller (31) is contacted with the feed roller (11) under pressure with the timing being slightly earlier to the contact of the other rocker roller (30).

The leading end portion of the band entering from one end of the loop arch guide (57), passes through the lower surface of the slide table (55) through the other end of the arch guide (57') to contact on the micro-lever (56), whereby the above-mentioned solenoid (42) is deactuated to separate the rocker rollers (30) and (31) from the feed roller (11) so that the feeding of the band may be completed.

The cycle of strapping operation is usually started from the above-mentioned condition.

In the above-mentioned condition of the operations, the base (20) of the differential reducing mechanism (7) and the seal forming shaft (10) are still in the stop condition of position, while the sprocket (14), in which one way clutch is provided, is rotated at low speed. However, the return shaft (15) is rotated at high speed through the pulley (8), gears (17) and (18) and the clutch (16) whereby the rotation of the return shaft (15) at high speed may not be affected owing to the reduced rotating operation of the sprocket (14) in which one way clutch (16) is provided.

In these operations, a package is put on the table, and the rotation of the return shaft (15) is forcibly stopped by engaging the disc (60) fixed to the sprocket body (19) with the stopping lever (61) whereby the seal forming shaft (10) which has been in a stopped state at this time starts to rotate at low speed.

When the seal forming shaft (10) is rotated at low speed, the first gripper (58) rises by operation of the cams (9), (63), (81), (89) fixed on the shaft and the other seven cams (not shown), whereby the leading end of the band is gripped between the left lower surface of the slide table (55) which has teeth shaped surface and the gripper.

When the center guide (54) is rewardly moved and the end of the arch guide (57) is simultaneously moved to pull out the band, as shown in FIG. 6, the cam roller (90) of the cam lever (86) for tightening the package is raised on the higher part of the cam (89) for tightening the package to cause the condition of braking the brake drum (70) shown in FIG. 5, and of forcibly stopping the disc (60) by stopping lever (61) being released. Thus, the sprocket (19) is rotated by the differential reducing mechanism whereby the seal forming shaft (10) is stopped.

The solenoid (41) is actuated to contact the rocker roller (40) with the return roller (13) being rotated at high speed whereby the band (4) is rewound to cause the primary tightening the package extended from the arch guide end (57) under relatively low tension.

This is the tightening operation high speed by the return roller (13) under a usual tension of 2 to 4 kg. When the tension reach as a predetermined tension, clutch (16) begins to slip whereby the rotating speed of the return shaft (15) is suddenly reduced.

When the rotating speed of the return shaft (15) is reduced to less than the rotating speed of the sprocket (14), the rotation of the sprocket (14), which has not imparted its function, is effectively transmitted to the return shaft (15), whereby the return roller (13) of the return shaft (15) is caused to tighten the package with the band as the secondary tightening operation by the rotation at low speed with high torque applied to the sprocket (19) of the differential reducing mechanism (7).

The tension can be controlled by controlling the braking power to the brake drum through the brake shoe (71) under controlling the rotating width of the brake operation shaft (75) through the adjacent screw (88).

When the load to the sprocket (19) by the tightening torque increases to a point greater than the load to the seal forming shaft (10) which is mainly the load by the brake drum (70) depending upon the increase of the tightening tension, the sprocket (19) and the sprocket (14) are stopped, whereby the seal forming shaft (10) starts to rotate at low speed. The second gripper (47) raises by the second gripper cam (9) on the shaft (10) to grip the band at the tightening side between the low surface of the first gripper (58) and the second gripper (47) (See FIG. 8 (C))

In the other embodiment, the return roller (13) is stopped by a stopper upon detecting a predetermined tension of the band whereby the rotation of the seal forming shaft (10) is started.

Then, the cam roller (90) of the cam lever (86) for tightening a package moves to the concentric portion lower than the highest portion of the cam (89) for tightening a package. The cam roller (82) formed on the leading end of the cam lever (78) rides on the highest portion of the cam (81), whereby the load applied to the brake drum (71) is strengthened but not weakened so as to always apply a desired constant tension to the band extending from the second gripper (47) by which the band is gripped, to the tightening mechanism of the machine at the melting time of the band even when the tightening tension is weak depending upon the kinds of the package.

When the cam roller (82) rides on the highest portion of the cam (81), the seal forming shaft (10) continues to rotate in the constant reduced speed after the momentary reduction of the rotating speed by again engaging the disc (60) mounted on the sprocket (19) with the lever (61). The heating element (53) as shown in FIG. 8, C and D is inserted between the two upper and lower bands subsequent to the operation of the above-mentioned second gripper (47). Then, the cutter anvil (45) rises to bring upwardly the lower band under the abovementioned tension, to contact with the heating element by means of the tension of the spring (65) and further to bring further upwardly both the lower band and the heating element to contact the heating element with the upper band, whereby the facing surfaces of the upper and lower bands are melted when the cam roller (64) of lever (59) connected to the supporting member (66) is shifted to the lowest portion of the cam (63).

The two bands are sealed under pressure by further rising of the cutter anvil (45) by shifting the lowest portion of the cam (63) to the position of the cam roller (64) after taking out the heating element from the superposed part of the bands in the rise of the seal press head (46) (See FIG. 8, E). As the cutter anvil (45) rises prior to rising the seal press head (46), the cutting of the band may be avoided.

During the time cooling the sealed bands under pressure, the cam roller (82) of the cam lever (78) is departed from the higher part of the cam (81). When the solenoid (41) is deactuated at this moment and then it is actuated again, the tension suitable for cutting the band, that is the tension for the primary tightening such as 2 to 4 kg, is applied to the band extended from the seal press head (46) to the tightening mechanism.

In this condition, the cutter anvil (45) is shifted down by shifting the cam roller (64) from the lowest part to the higher part of the cam (63), to cut the band with the knife (51) fixed on the side surface of the seal press head (46). The cutting of the band is carried out in the condition applying the primary tension to the band.

The timing is adjusted to the moment of finishing the cutting of the band, and the solenoid (41) is deactuated immediately to stop the rear running of the band.

That is, the primary tension is applied at the time cutting the band, whereby the band is returned to the feeding side at the moment of cutting the band. However, even though the timing deactuating the solenoid is not optimum, the leading end of the band is returned only between the feed roller (11) and the return roller (13), whereby there is no trouble for feeding the band in the next operation.

The seal forming shaft (10) is further rotated to descend the seal press head (46) and the second gripper (47), and then, to descend the first gripper (58), and further, the slide table (55) and the first gripper (58) are simultaneously rewardly moved to separate the sealed band from the lower surface of the slide table (55). Then, the center guide (54), the slide table (55) and the first gripper (58) are simultaneously forwardly moved to return the cutter anvil (45), the microlever (56) and, the arch guide ends (57), (57') to their original positions. At the time just before the time required for stopping the cam shaft, the engagement of the disc (60) with the stopping lever (61) is released.

Then, the next feeding of the band is started by the actuation of the solenoid (42) with the end pushing the microlever (56) to provide the condition completing the feeding of the band. One cycle of the strapping operation is thus completed. The operation for strapping a usual package has therefore been illustrated.

When high tension in tightening is required, the solenoid (41) is deactuated once after gripping the band by the second gripper (41) to release the tension of the band extended from the second gripper (47) to the tightening mechanism. The solenoid (41) is actuated again to attain the purpose.

In accordance with the present invention, as clearly understood from the above description, the tension is applied to the band from the superposing operation to the heat-sealing under pressure, and the band is cut at the time of finishing the heat-sealing under pressure by cooling the bands, whereby the slip of the superposed part is not found and the heat-sealed strength is high enough and a narrow band can be used without trouble.

When the heating element is taken out, it is carried out under application of a constant tension to the band, whereby the difference of the resistance for taking out the heating element is substantially negligible regardless the difference of thickness of the band. The band is not slipped out and the slip of the superposed part is not found.

In the cutting of the band, the tension suitable for cutting the band which corresponds to the primary tightening tension is applied, whereby the band is easily cut with less resistance and the life of the cutter can be prolonged.

When the band is strapped on the package having narrow width, suitable length of the melting parts can be provided and the width of the slide table can be narrow, whereby the loose characteristic of the band after strapping the band can be decreased in comparison with a conventional machine. Packaging having higher tension can thus be attained and the number of parts for operating the gripper such as the cam, the cam roller and the cam lever can be reduced. Obviously, many modifications and variations of the present invention are possible in light of the above teachings. It is therefore to be understood that within the scope of the appended claims the invention may be practiced otherwise than as specifically described herein.

What is claimed is:

1. A strapping machine for providing a tensioned loop of band material about a package which comprises:
- driving means mounted on said strapping machine;
- a differential reducing mechanism;
- a first shaft operably interconnecting said driving means and differential reducing mechanism;
- a second shaft mounted on said strapping machine and disposed adjacent said first shaft;
- first interconnecting means mounted on said second shaft for operatively interengaging said second shaft with said differential reducing mechanism;
- a first band feed roller mounted on said second shaft and rotatable in a band feed direction;
- a third shaft mounted on said strapping mechanism and disposed adjacent said second shaft;
- second interconnecting means mounted on said third shaft for operatively interengaging said third shaft with said differential reducing mechanism;

a second band feed roller mounted on said third shaft adjacent said first band feed roller and rotatable in a direction opposite that of said first band feed roller;

means for feeding said band by engaging said band with a surface of said first band feed roller only, so as to form a band loop with a leading end of the band disposed in overlapping relationship with a remaining portion of the band;

means for gripping the leading end of the band mounted on said strapping machine and operatively engageable with said first shaft;

means for tensioning said band by engaging said band with a surface of said second band feed roller only;

means for melting an inner surface of the band mounted on said strapping machine so as to form a closed loop of the band; and means for cutting the band mounted on said strapping machine.

2. The strapping machine as set forth in claim 1, wherein:

said means for tensioning said band includes;

clutch means mounted on said third shaft; and first and second interengaging gears mounted on said second shaft and said clutch means, respectively, so as to provide an initial tensioning of the band due to rotation of the third shaft at a high speed and to transmit driving force to the third shaft from said second interconnecting means at a low speed with high torque.

3. The strapping machine as set forth in claim 1, which further comprises:

cam means mounted on said first shaft operatively connected to said feeding means, said gripping means, said melting means, and said cutting means, respectively.

4. A strapping machine as set forth in claim 1, wherein:

said feeding means includes first and second rocker rollers mounted on said strapping machine and means for contacting said first and second rocker rollers with said first feed band roller so as to engage the band with the surface of said first band feed roller;

wherein said means for tensioning said band includes a third rocker roller mounted on said strapping machine and means for contacting said third rocker roller with said second feed band roller so as to engage the band with the surface of said second feed band roller.

5. A strapping machine as set forth in claim 1, wherein said means for tensioning said band includes clutch means mounted on said third shaft, and first and second interengaging gears mounted on said second shaft and said clutch means, respectively, so as to provide an initial tensioning of the band due to rotation of the third shaft at a high speed and to transmit driving force to the third shaft from said second interconnecting means at a low speed with high torque and wherein said strapping machine further comprises cam means mounted on said first shaft operatively connected to said feeding means, said gripping means, said melting means, and said cutting means, respectively.

6. A strapping machine as set forth in claim 1, which further comprises:

cam means mounted on said first shaft operatively connected to said feeding means, said gripping means, said melting means, and said cutting means, respectively, wherein said feeding means includes first and second rocker rollers mounted on said stripping machine and means for contracting said first and second rocker rollers with said first feed band roller so as to engage the band with the surface of said first band feed roller and said means for tensioning said band includes a third rocker roller mounted on said stripping machine and means for contacting said third rocker roller with said second feed band roller so as to engage the band with the surface of said second feed band roller.

7. A strapping machine as set forth in claim 1, wherein axes of rotation of said first, second and third shafts are parallel.

* * * * *